US007224816B2

(12) United States Patent
Naito et al.

(10) Patent No.: US 7,224,816 B2
(45) Date of Patent: May 29, 2007

(54) WAVED/CORRUGATED AND STEPPED SURFACE DESIGN FOR SPEAKER BOX, AND METHOD OF STANDARDIZATION OF SPEAKER BOX ASSEMBLIES FOR TELEVISION OF DIFFERENT SCREEN SIZES

(75) Inventors: Ryoji Naito, San Diego, CA (US); Ada Saulai Choi, San Diego, CA (US)

(73) Assignees: Sony Corporation (JP); Sony Electronics, Inc., Park Ridge, NJ (US)

( * ) Notice: Subject to any disclaimer, the term of this patent is extended or adjusted under 35 U.S.C. 154(b) by 561 days.

(21) Appl. No.: 10/462,772

(22) Filed: Jun. 17, 2003

(65) Prior Publication Data

US 2004/0008856 A1 Jan. 15, 2004

Related U.S. Application Data

(62) Division of application No. 09/593,168, filed on Jun. 14, 2000, now Pat. No. 6,580,802.

(51) Int. Cl.
*H04R 25/00* (2006.01)

(52) U.S. Cl. ..... 381/388; 381/306; 381/333; 312/7.2

(58) Field of Classification Search ..... 181/155–156, 181/175–176, 199; 381/306, 333, 336–339, 381/352, 160, 388, 395; 312/7.2; 348/836; 361/681–682

See application file for complete search history.

(56) References Cited

U.S. PATENT DOCUMENTS 6,529,610 B1 * 3/2003 Ogawa et al. ..... 381/388

* cited by examiner

*Primary Examiner*—Suhan Ni
(74) *Attorney, Agent, or Firm*—Rader Fishman & Grauer PLLC; Ronald P. Kananen

(57) ABSTRACT

A speaker bracket, speaker baffle, and a speaker cover are provided for standardizing speaker box assemblies for television sets having different sized speakers. A speaker box assembly includes a speaker cover having a stepped inverted surface. A speaker bracket is then installed onto the speaker cover using a securing member. A surface of the speaker bracket is then mated with a speaker bore. The speaker bracket can have a stepped inclined surface sized to closely fit inside the stepped inverted surface of the speaker cover. The step of installing the speaker bracket onto the speaker cover then includes fitting the stepped inclined surface of the bracket with the stepped inverted mating surface of the speaker cover. The speaker cover has an elliptical frustum surface having steps that create an increasing circumference at fixed intervals along a length of the speaker box, and includes grooves that run along the length of the speaker box, perpendicular to the steps. The speaker baffle has corrugations formed along a length of the surface.

11 Claims, 20 Drawing Sheets

WAVED/CORRUGATED AND STEPPED SURFACE DESIGN FOR SPEAKER BOX, AND METHOD OF STANDARDIZATION OF SPEAKER BOX ASSEMBLIES FOR TELEVISION OF DIFFERENT SCREEN SIZES

This application is a divisional application of Ser. No. 09/593,168 filed Jun. 14, 2000 now U.S. Pat. No. 6,580,802.

FIELD OF THE INVENTION

The present invention relates to the field of television speakers. More particularly, the present invention relates to the field of television speaker boxes and methods for enclosing speakers inside television units.

BACKGROUND OF THE INVENTION

As television sets have become more readily available for consumers of all classes, a variety of options have become available for consumers to choose from when buying a television set. For example, consumers can choose what size of screen they would like to view, and the quality of sound that is associated with the television set. Consumers who prefer a television set that produces an image using a cathode ray tube, and prefer larger screens as well, often choose from 27-inch screens, 32-inch screens, and 36-inch screens. However, the weight of the television increases with the screen size. This is partly due to the size of, and materials used to make the components such as the speaker box assembly for the larger television sets. A current 36-inch television speaker box assembly is very heavy when compared to the speaker box assembly for a 32-inch or 27-inch television. This is partly because the speaker box assembly for each of the television sets is a different size, with larger and heavier assembly parts being used for larger television sets. The lack of standardization of the speaker box assemblies also produces inefficiency in television set production, resulting in greater costs for the manufacturer.

In order to make television sets price competitive, it is important to reduce the amount of material used. However, it is important when considering redesigning speaker box assemblies to ensure that reduction in material does not result in loss of speaker box strength. Any new speaker box assembly design must take into consideration the need to have sufficient mechanical strength or stiffness to resist sound vibration, and at the same time create good quality sound for the whole speaker box assembly.

Speaker box assemblies conventionally include two components: a speaker baffle and a speaker cover. Conventional television set speaker baffles utilize the concept of flat surfaces with reinforcing rib structures. While this design provides the necessary stiffness to withstand sound vibration, the speaker baffles are relatively heavy, since more plastic material is used to form webs of reinforcing ribs. Conventional television set speaker covers are also produces using the concept of flat surfaces with reinforcing rib structures, and also have the shape of a one-side opened rectangular box. While this design provides the necessary stiffness to the part and provides sufficient enclosure volume for sound reproduction, the speaker covers are relatively heavy, again because a great amount of plastic material is used to form webs of reinforcing ribs.

SUMMARY OF THE INVENTION

It is therefore an object of the present invention to meet the above-described needs by standardizing a speaker box assembly for television sets of different sizes, or having different sized screens. Other objects of the invention are apparent from the following description of the invention and the drawings included herewith.

The present invention includes a television set speaker bracket that has a stepped inclined surface that is sized to closely fit inside a stepped inverted semi-frustum surface of a television set speaker cover, at least one attachment member for attaching the speaker bracket with said speaker cover, and a stepped inverted surface that mates with a television set speaker boss. In one embodiment, the television set using the bracket can be the type having a 32-inch viewing screen or a 36-inch viewing screen. In such case, the speaker cover can be the same size as that used in a television set having a 27-inch viewing screen.

The television set speaker boss is disposed on an interior surface of a rear cover of said television set. The stepped inverted surface of the bracket has a stepped portion and an inverted surface. The inverted, semi-frustum shaped surface acts as a guide for the easy engagement of the speaker bracket and the speaker boss. In order to provide a best fit and easy installation, the stepped inverted surface that mates with the television set speaker boss is a semi-frustum shaped surface.

The present invention also includes a television set that has in combination a speaker cover having a stepped inverted surface as described above, a speaker boss that is attached to an interior surface of a rear cover of the television set, and the speaker bracket described above, having a stepped inclined surface that is sized to closely fit inside the stepped inverted surface of the speaker cover, at least one attachment member for attaching the speaker bracket to the speaker cover, and a stepped inverted surface that acts as a guide for the easy engagement of the speaker bracket and the speaker boss as described above. The stepped inverted surface of the bracket is a semi-frustum shaped surface. The speaker cover is of a size that is used in a television set having a 27-inch viewing screen.

The stepped inverted surface of the bracket has a stepped portion and an inverted surface, the inverted surface acting as a guide for the easy engagement of the speaker bracket and the speaker boss. The attachment member can be one or more screws. In such a case, the speaker cover includes a first bore, and the bracket includes a second bore. The screw then extends through the first and second bores.

The television set further includes a speaker baffle that has a corrugated surface. The corrugated surface is formed with a curvature that fits the speaker baffle around a cathode ray tube in the television set. The corrugated surface has a plurality of crests and valleys, that can extend in a direction that is perpendicular to a valley formed by the curvature. The uppermost portions of the crests can share a common plane. The valleys of the corrugations can each have a bottom-most surface, where the bottom most surfaces also share a common plane.

The present invention also includes a method for standardizing speaker box assemblies for television sets having different sized speakers. A speaker box assembly is provided that includes a speaker cover having a stepped inverted surface. A speaker bracket is also provided. The speaker bracket is then installed onto the speaker cover using a securing member. Then, a surface of the speaker bracket is mated with a speaker boss disposed on a cover of the television set.

The speaker bracket used in the method can have a stepped inclined surface that is sized to closely fit inside the stepped inverted surface of the speaker cover. If so, the step of installing the speaker bracket onto the speaker cover includes fitting the stepped inclined surface of the bracket with the stepped inverted surface of the speaker cover. To make a close fit, the stepped inclined surface of the bracket is a semi-frustum shaped surface, and the stepped inverted surface of the speaker cover is also a semi-frustum shaped surface.

The speaker bracket used in the method can also have a stepped inverted surface. If so, the step of mating a surface of the speaker bracket with a speaker boss includes mating the stepped inverted surface of the speaker bracket with the speaker boss.

The at least one securing member can include a screw. If so, the speaker cover includes a first bore, and the bracket includes a second bore. The screw extends through both the first and second bores.

The speakers can be components of a television set having a 32-inch viewing screen, or components of a television set having a 36-inch viewing screen. In either case, the speaker cover is of a size that is used in a television set having a 27-inch viewing screen.

The method can also include forming the speaker box with an elliptical frustum surface having steps that create an increasing circumference at fixed intervals along a length of the speaker box. The speaker box can also be formed to have grooves that run along the length of the speaker box, perpendicular to the steps.

The method also can include the step of attaching a speaker baffle to the speaker box. The speaker baffle can have a corrugated surface where corrugations are formed along a length of the surface. The speaker baffle supports a plurality of speakers. The speaker baffle is further described above.

Also, the present invention includes a television set speaker cover that includes an elliptical frustum surface having steps that create an increasing circumference at fixed intervals along a length of the speaker box. The speaker cover further includes grooves that run along the length of the speaker box, perpendicular to the steps. The speaker cover has a stepped inverted semi-frustum surface as described above.

The present invention further includes a television set speaker baffle that has a corrugated surface, where corrugations are formed along a length of the surface. The speaker baffle supports a plurality of speakers. The corrugated surface is curved to allow the baffle to fit around a cathode ray tube in the television set. The corrugated surface is formed with a curvature that fits the speaker baffle around a cathode ray tube in the television set. The corrugated surface has a plurality of crests and valleys that can extend in a direction that is perpendicular to a valley formed by the curvature. The uppermost portions of the crests can share a common plane. The valleys of the corrugations can each have a bottom-most surface, where the bottom-most surfaces also share a common plane.

Additional objects, advantages and novel features of the invention will be set forth in the description which follows or may be learned by those skilled in the art through reading these materials or practicing the invention. The objects and advantages of the invention may be achieved through the means recited in the attached claims. To achieve these stated and other objects, the present invention may be embodied and described as follows.

BRIEF DESCRIPTION OF THE DRAWINGS

The accompanying drawings illustrate the present invention and are a part of the specification. Together with the following description, the drawings demonstrate and explain the principles of the present invention.

DETAILED DESCRIPTION OF THE PREFERRED EMBODIMENTS

Figure 1:
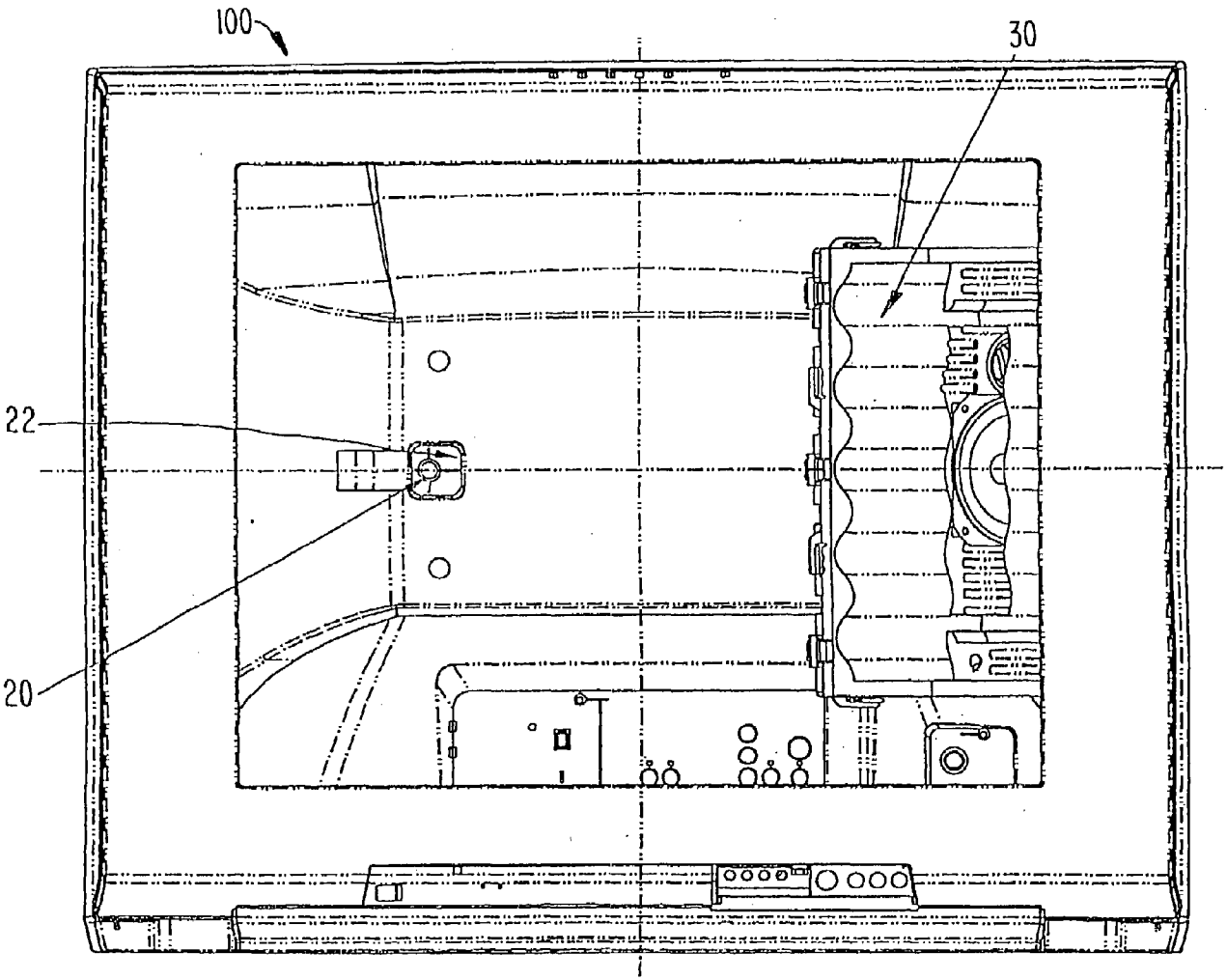
FIG. 1 is an inside view of a television set, with the television screen removed to view the interior of the television.

Using the drawings, the preferred embodiments of the present invention will now be explained. As shown in FIG. 1, when viewing the inside of a television 100 having a 27-inch, 32-inch, or 36-inch screen, a speaker box assembly 50 as that shown on the right side can be seen with the television screen removed to view the interior of the television. In the past, speaker box assemblies have been differently sized to accommodate the different sized screens and the various depths of television sets. Another speaker box assembly normally appears on the left side as well to provide a stereophonic sound. In FIG. 1, the left side speaker box assembly is removed to show a rear speaker cover boss 20 mounted on a platform 22 that is in turn mounted on the rear cover 25 of the television set.

Figure 2:
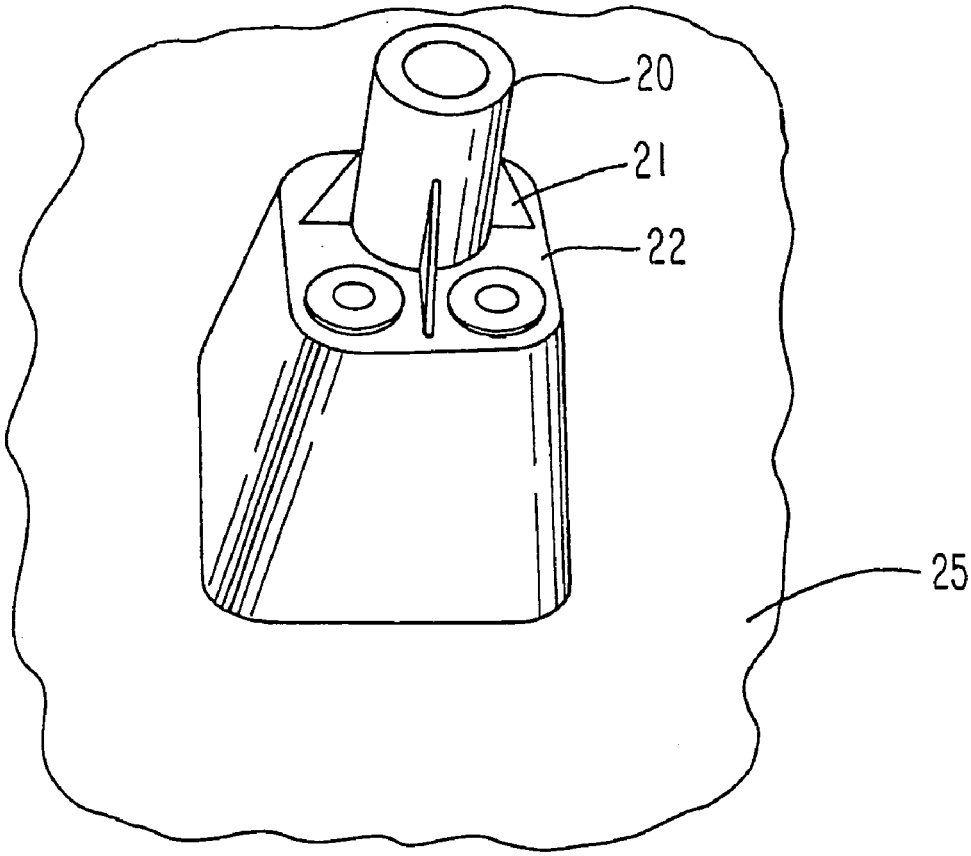
FIG. 2 is a view of a platform and speaker boss combination attached to the inside surface of the rear cover of a television set.

As shown in FIG. 2, the rear speaker boss 20 is mounted on a platform 22. Reinforcement ribs 21 provide enough support to the boss 20 to allow it to support the weight of the speaker box assembly 50 shown in FIG. 1. If so desired, the ribs can be sized to also serve the purpose of engaging with a surface of the speaker box. While three ribs are shown in the Figures, the present invention can use as little as one rib, or more than three ribs.

Figure 3:
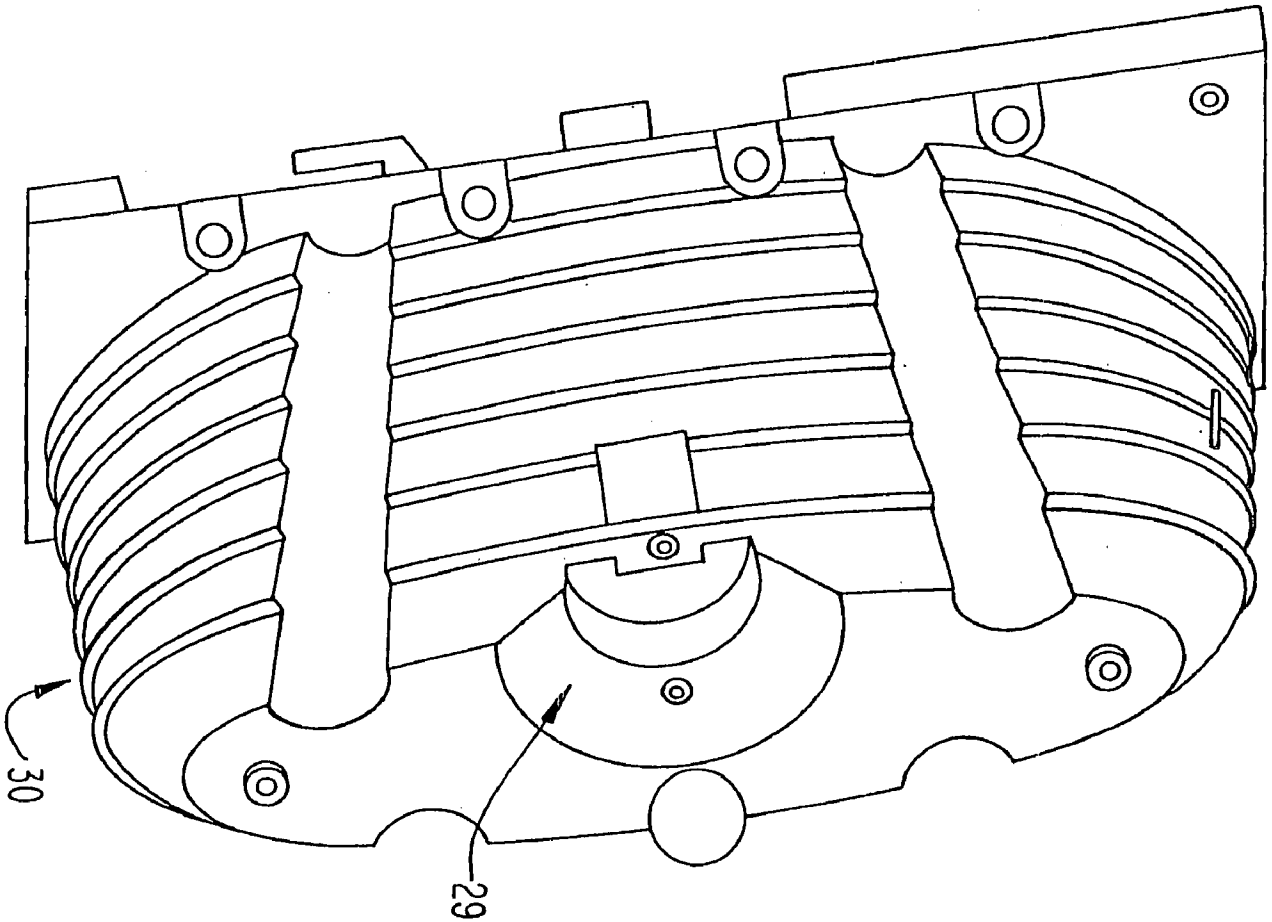
FIG. 3 is a view of a speaker cover according to the present invention.

When the speaker boss 20 is part of a 27-inch television set, the boss 20 engages directly with a speaker cover 30 such as that shown in FIG. 3. The speaker cover 30 includes a surface 29 that is stepped and inverted so as to decline inwardly relative to the speaker cover 30 body. The surface thus forms, in part, a semi-frustum shape, used as a guide rail for the rear cover speaker boss 20 when it is engages with the speaker cover 30. Together, the boss 20 and the surface 29 support the whole speaker box assembly 50.

Figure 4A:
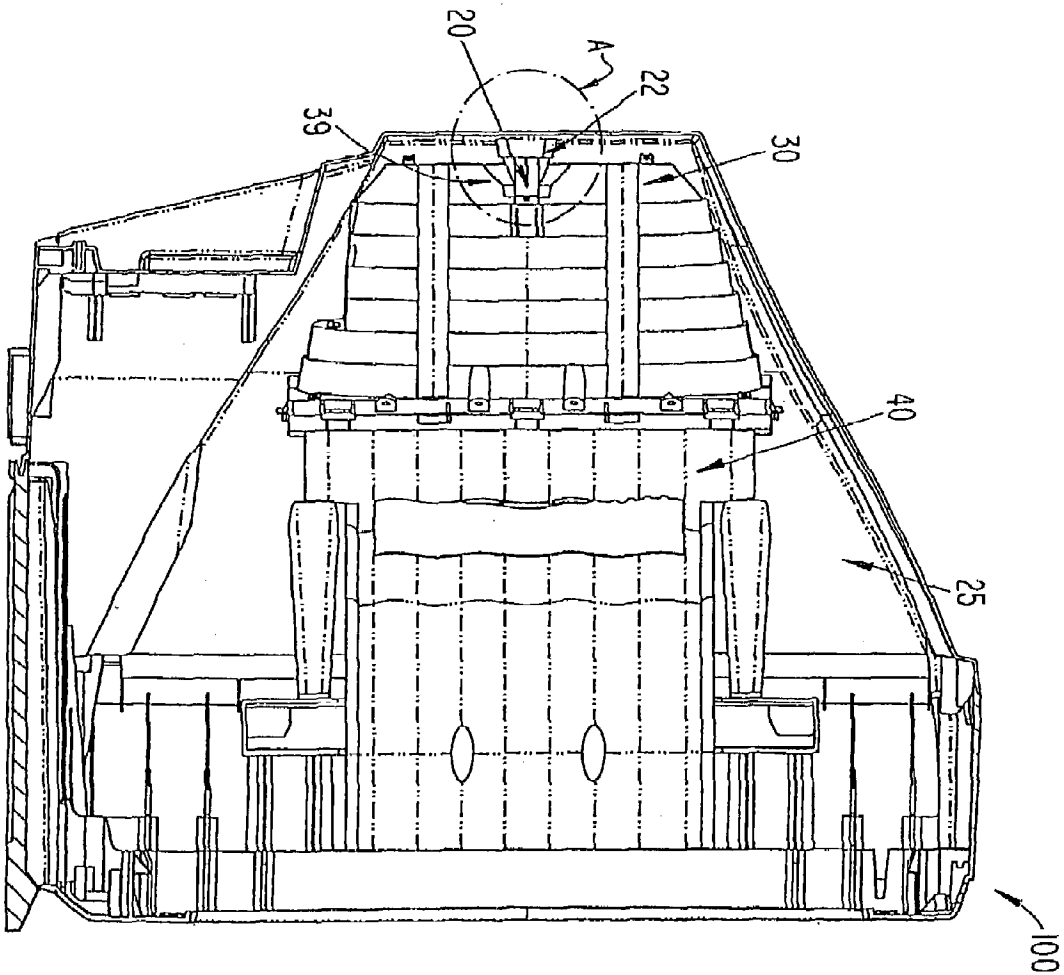
FIG. 4*a* is a left inside view of a 27-inch television set utilizing the speaker cover of the present invention.
Figure 4B:
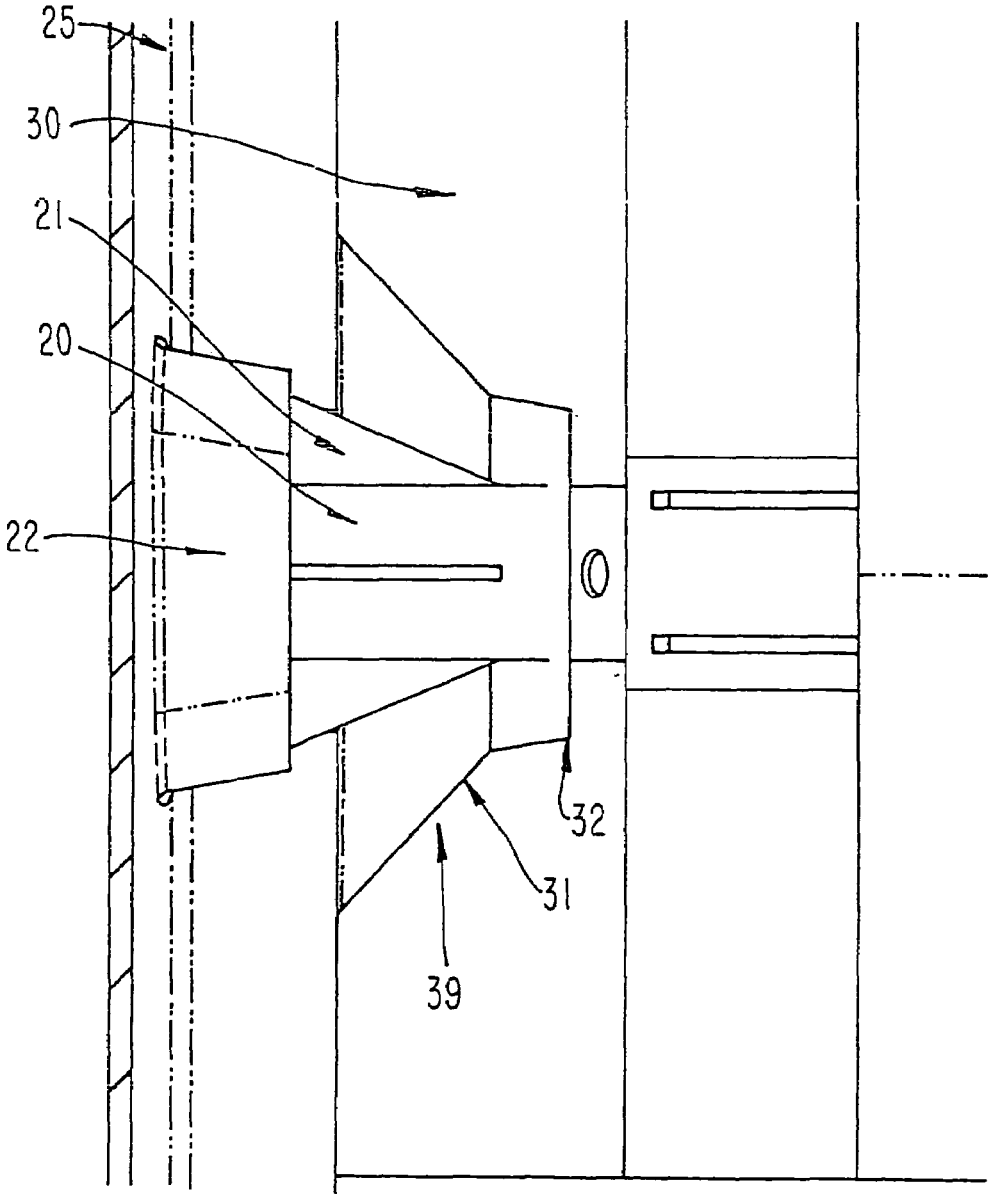
FIG. 4*b* is a close-up view of area A from FIG. 4*a*, showing the guide surface engaged with the speaker boss using the speaker cover of the present invention.

FIG. 4*a* is a left inside view of a 27-inch television set 100 utilizing the speaker cover of the present invention, although the right side view would be substantially be a mirror image for purposes of exhibiting the principles of the invention. As shown, a speaker baffle 40 is attached to the speaker cover 30. The rear cover speaker boss 20 is disposed at a rearmost area of the rear cover 25 of the television set 100. FIG. 4*b* is a close-up view of area A from FIG. 4*a*, and specifically shows how a portion 31 of the guide surface 29 of the speaker cover 30 engages with the boss 20. The speaker baffle 40 has a corrugated surface 51 that is formed with a curvature that fits the speaker baffle around a cathode ray tube in the television set 100. The corrugated surface 51 has a plurality of crests and valleys, that can extend in a direction that is perpendicular to a valley formed by the curvature. The uppermost portions of the crests can share a common plane. The valleys of the corrugations can each have a bottom-most surface, where the bottom-most surfaces also share a common plane.

Figure 5A:
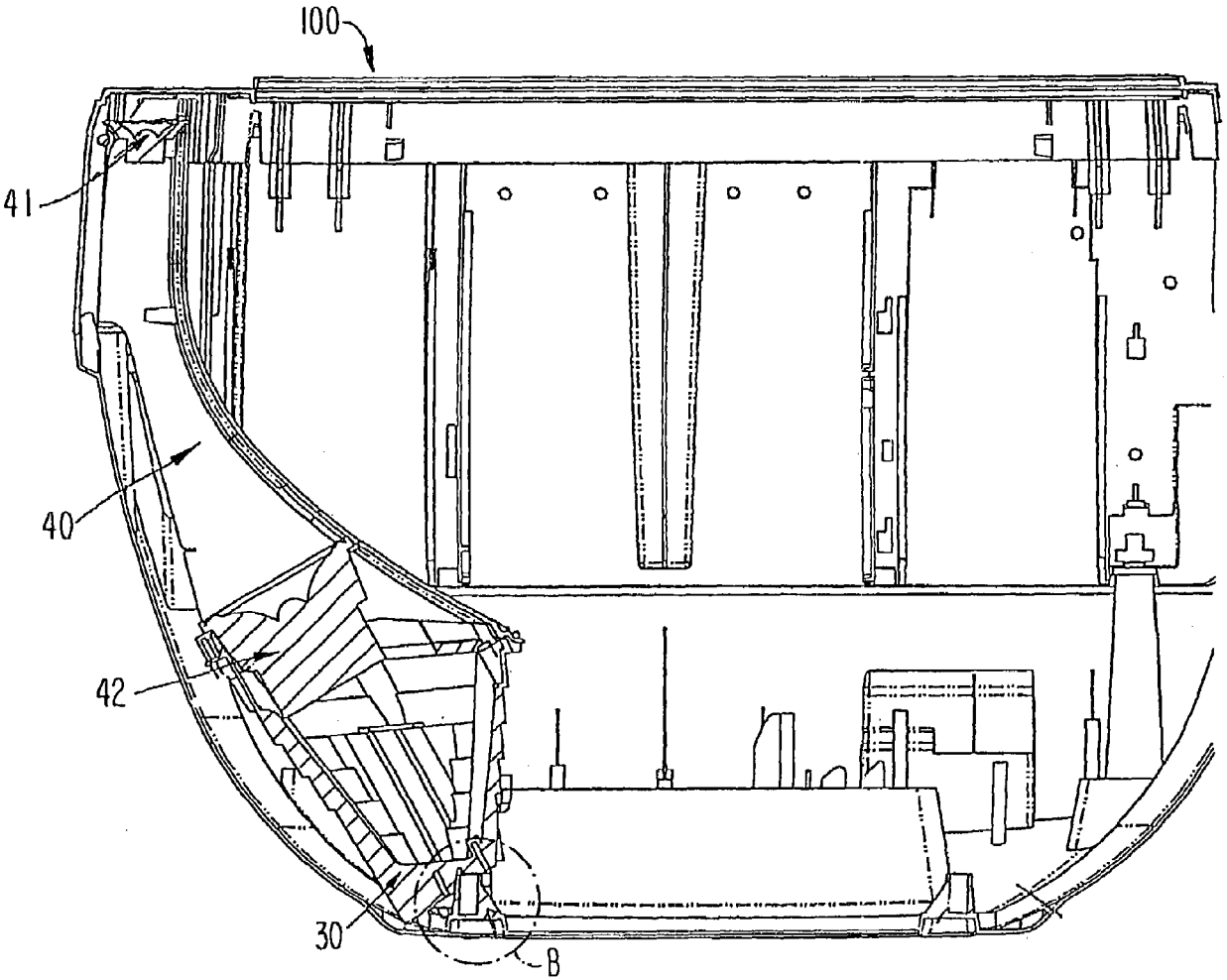
FIG. 5*a* is a top inside view of a 27-inch television set utilizing the speaker cover of the present invention.
Figure 5B:
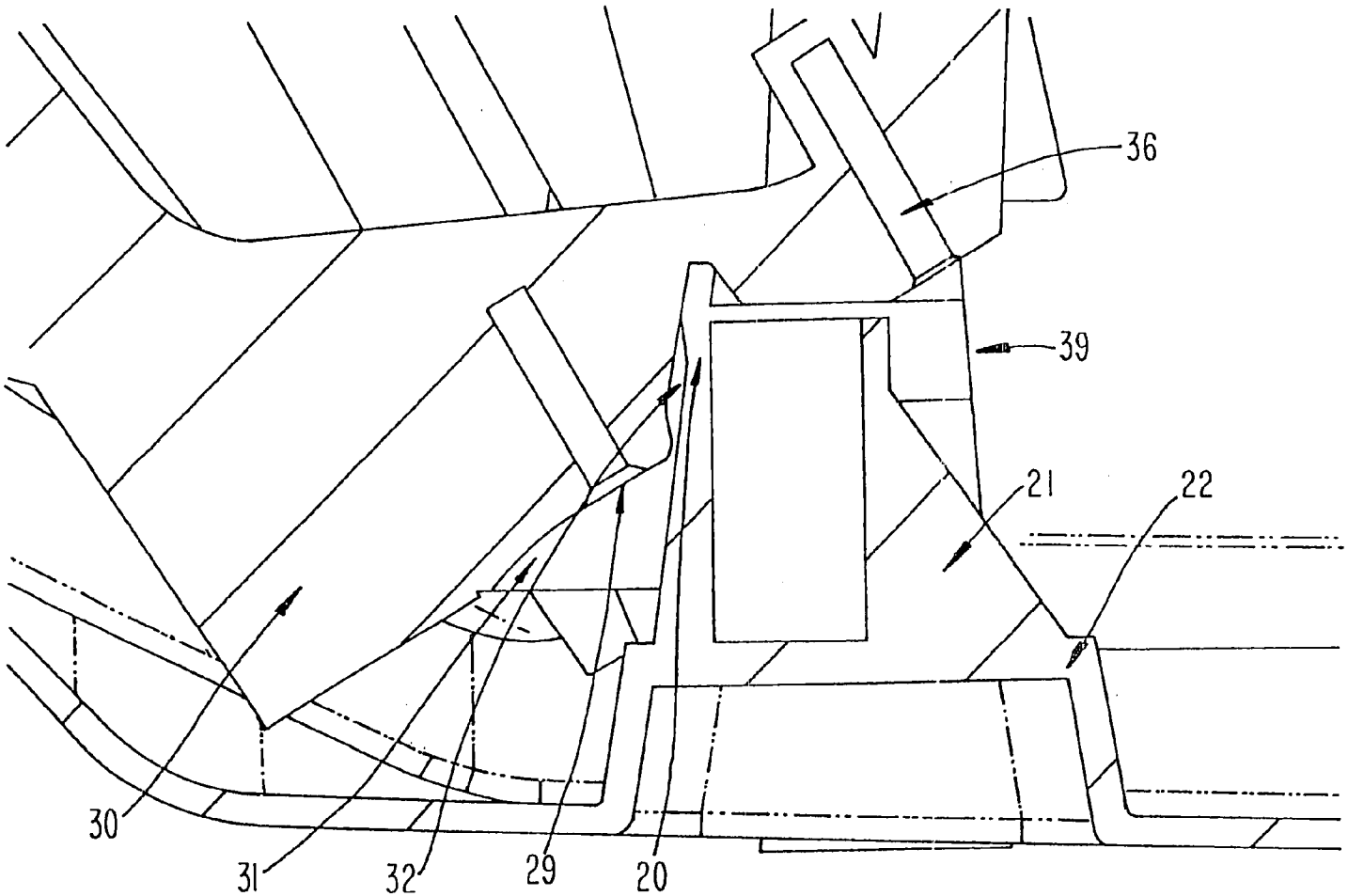
FIG. 5*b* is a close-up view of area B from FIG. 5*a*, showing the guide surface engages with the speaker boss using the speaker cover of the present invention.

FIG. 5*a* is a top inside view of a 27-inch television set utilizing the speaker cover of the present invention. As is shown, a smaller speaker such as a 5 cm tweeter 41 is often located toward the front of the television set 100. The speaker cover 30 and speaker baffle 40 support a larger speaker such as a 10 cm main speaker 42. The larger speaker 42 is disposed rearward relative to the smaller speaker 41. FIG. 5*b* is a close-up view of area B from FIG. 5*a*, showing how a portion 31 of the guide surface 29 engages with the speaker boss 20 using the speaker cover 30 of the present invention. Screw holes 35, 36 are provided in the guide surface 29, although they are not used with a 27-inch television. Rather, the screw holes 35, 36 are provided to allow the guide surface 29 to be attached to a later described speaker bracket 37 shown in FIGS. 6, 7, and 8, when the television set is a 32-inch or 36-inch television. As shown in FIG. 5*b*, the ribs 21 strengthen and provide support to the speaker boss 20 when it is engaged with the portion 31 of the guide surface 29. The portion 31 of the guide surface 29 to which the speaker boss 20 is engaged is adjacent to, and in fact can include the stepped portion 32 of the guide surface 29. The ribs 21 actually guide the manufacturer during assembly of the television set 100 to ensure that the speaker boss 20 is inserted as far as possible into the inverted and stepped semi-frustum surface 29 located at the back of the speaker cover 30.

Figure 6:
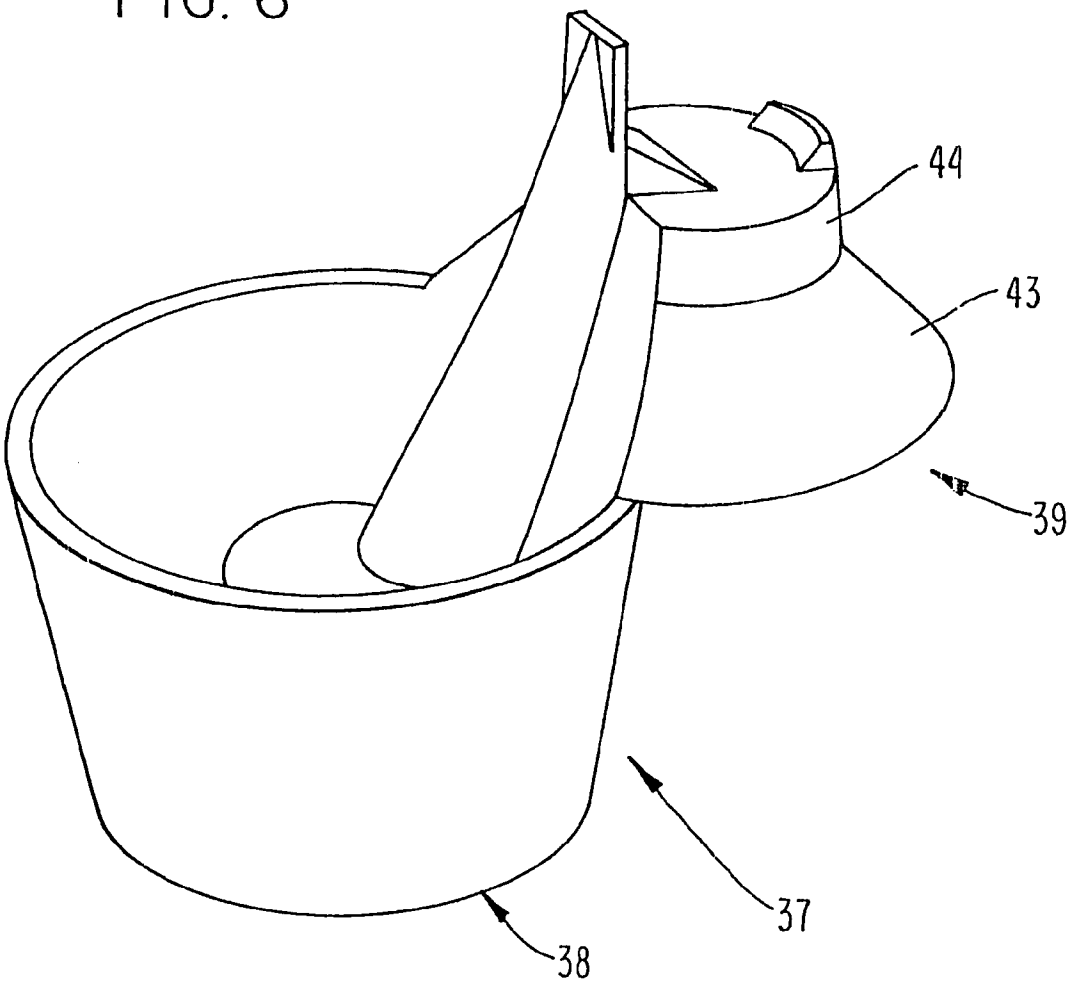
FIG. 6 is a top-side view of a speaker bracket of the present invention for use with 32-inch and 36-inch television sets.
Figure 7:
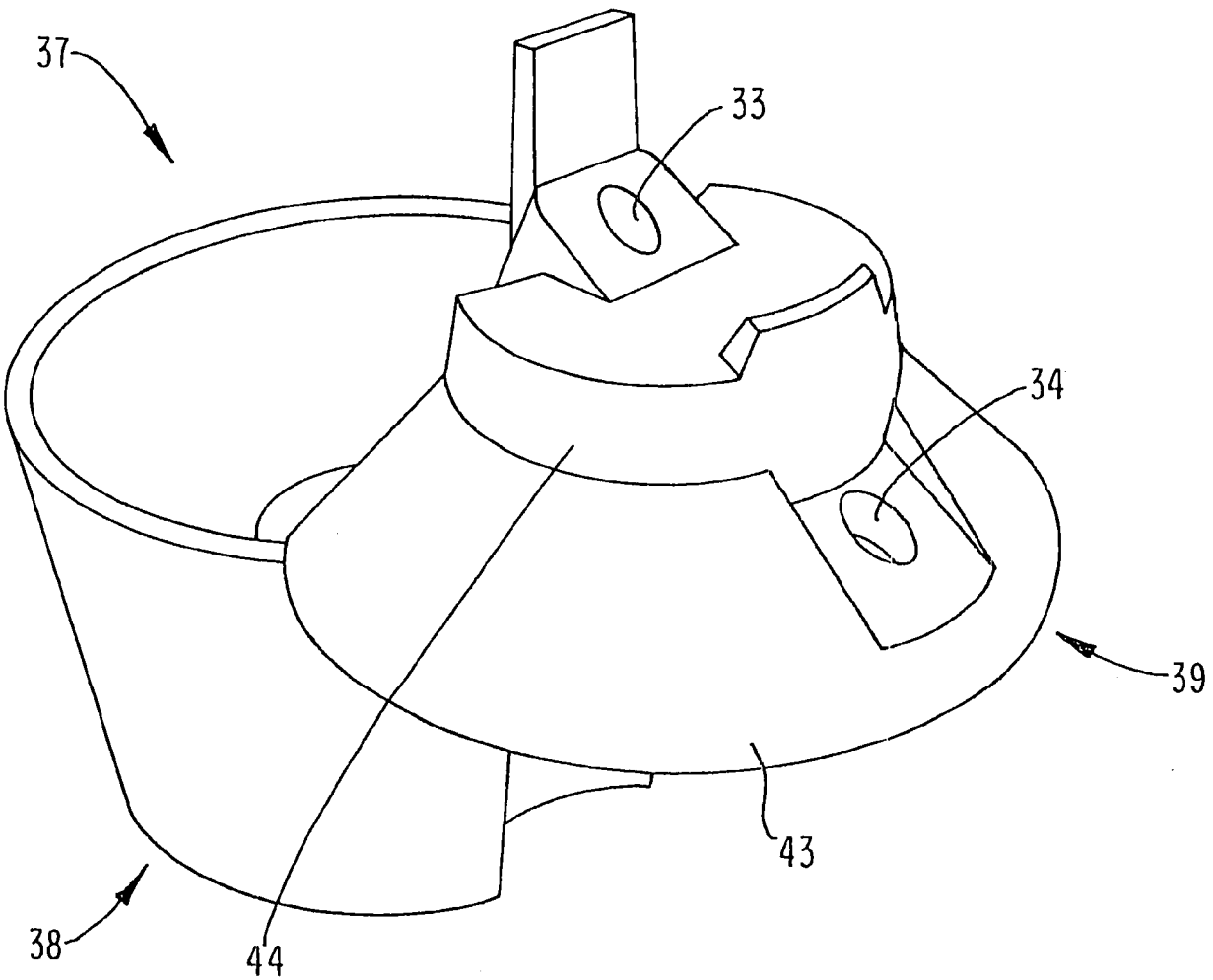
FIG. 7 is a front view of the speaker bracket of the present invention, showing the screw holes included in the guide structure.
Figure 8:
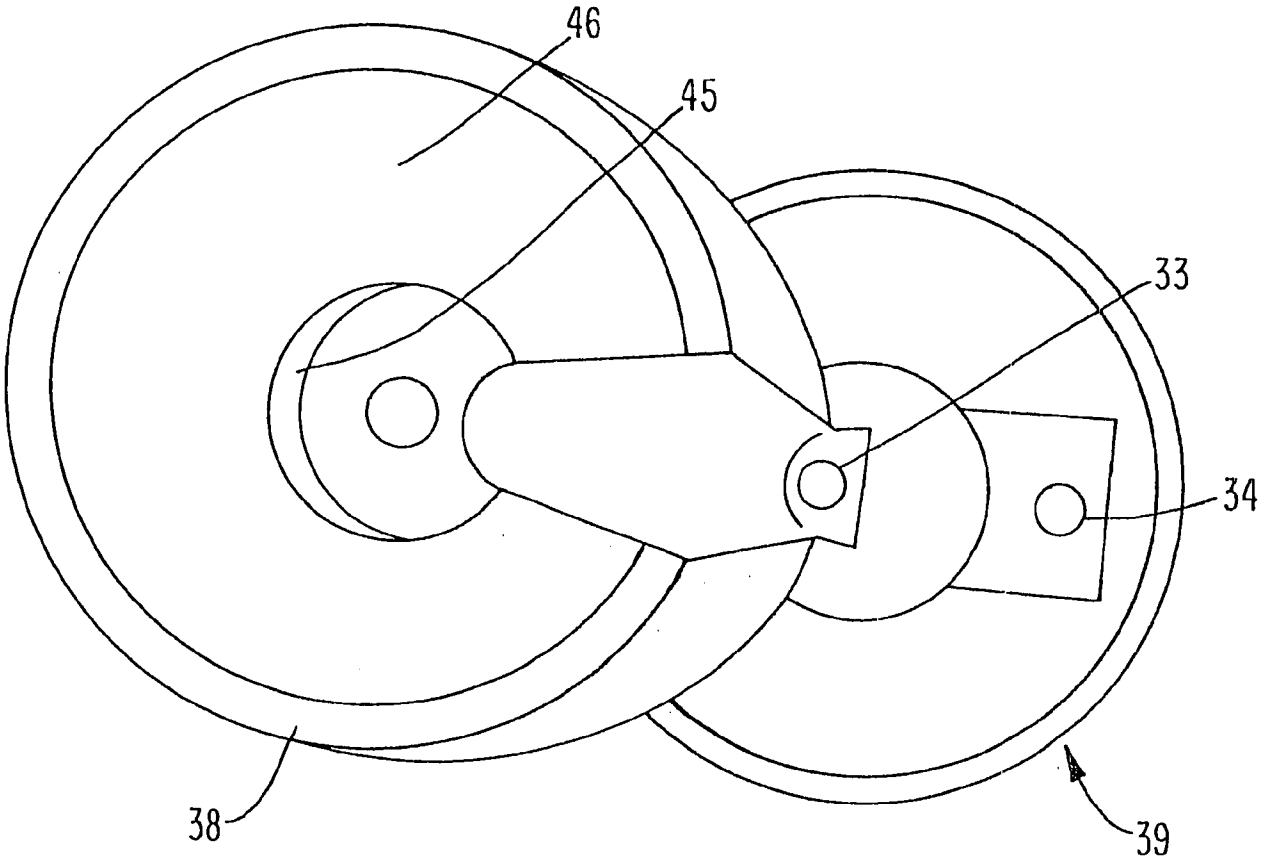
FIG. 8 is a bottom view of a speaker bracket of the present invention for use with 32-inch and 36-inch television sets.

FIGS. 6, 7, and 8 show the speaker bracket 37 of the present invention. As explained above, the speaker bracket 37 enables the same speaker box assemblies 50 for 27-inch television sets 100 to be used with larger 32-inch or 36-inch television sets 200. Without the speaker bracket 37, there is a gap of approximately 70 mm in between the rear cover speaker boss 20 and the speaker cover 30. Without the speaker bracket 37 of the present invention, the speaker boss 20 that is part of a 32-inch or 36-inch television 200 is unable to support a speaker box assembly 50 used with the 27-inch television 100; a larger, heavier speaker box assembly would therefore need to be developed. The speaker bracket 37 of the present invention thus acts as an extension device between a speaker cover 30 and a speaker boss 20 for supporting the speaker box assembly 50.

The speaker bracket assembly 37 includes a front portion 39, and a rear portion 38. The front portion 39 and the rear portion 38 are joined as a uniformly molded piece 37. The speaker bracket 37 can be made of a hard metal or other material that is sufficiently strong to support a speaker box assembly 50 in a television set.

Figure 9:
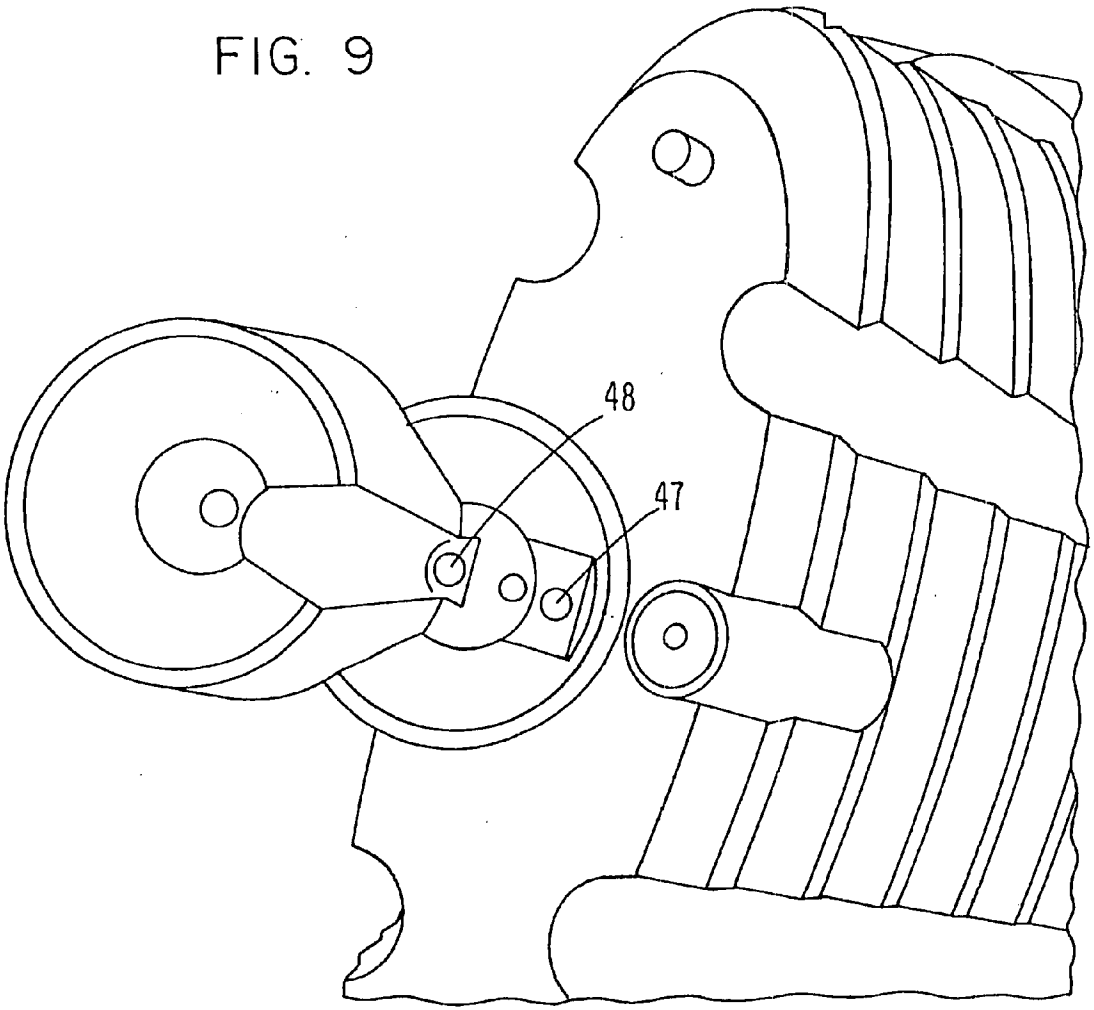
FIG. 9 shows the speaker bracket for use with 32-inch and 36-inch television sets, attached to the speaker cover according to the present invention.

The front portion 39 has an outer surface that is shaped to match the inverted and stepped semi-frustum surface 29 located at the back of the speaker cover 30. An inclining surface 34 has a starting maximum diameter, and is inclined at an angle to snugly fit against the inverted surface 29 of the speaker cover. Also, a stepped portion 44 is of a diameter to snugly fit against the stepped portion 32 of the surface 29. When the bracket 37 is placed in correct contact with the speaker surface 29, screw holes 33 and 34 are in alignment with screw holes 36 and 35 of the speaker cover 30, respectively. FIG. 9 shows the speaker bracket 37 correctly contacted with the speaker cover 30. Screws 47 and 48 are provided to attach the bracket 37 with the speaker cover 30.

As shown in FIG. 8, the bracket 37 has a stepped semi-frustum surface that includes a stepped portion 45 and an inclined surface 46. The stepped semi-frustum surface is used as a mating surface for the speaker boss 20 in the same manner as the stepped semi-frustum surface of the speaker cover 30 when installed into a 27-inch television.

Figure 10:
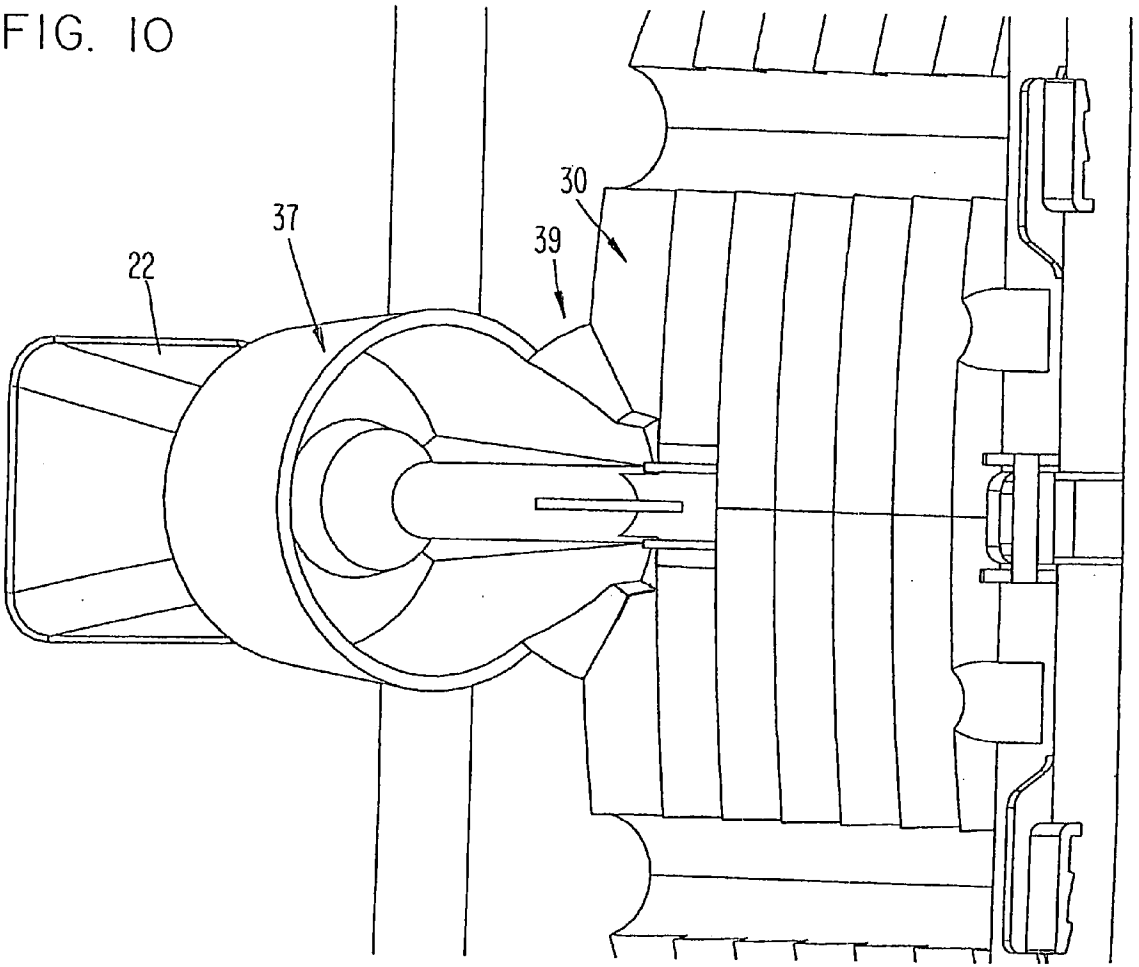
FIG. 10 is an isomeric view of the speaker bracket for use with 32-inch and 36-inch television sets, attached to the speaker cover according to the present invention, and engaged with the speaker boss.
Figure 11:
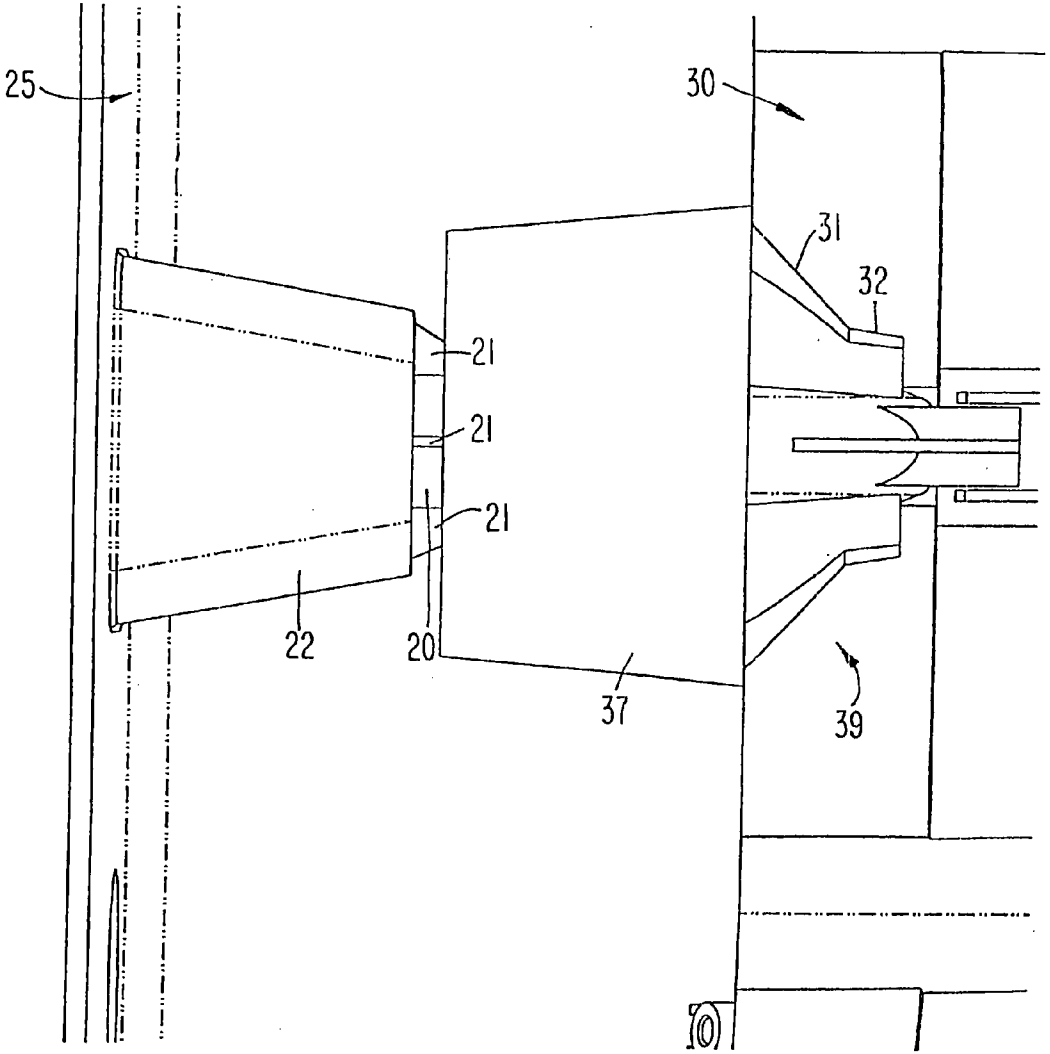
FIG. 11 is a front side view of the speaker bracket combination attached to the speaker cover and engaged with the speaker boss according to the present invention.
Figure 12:
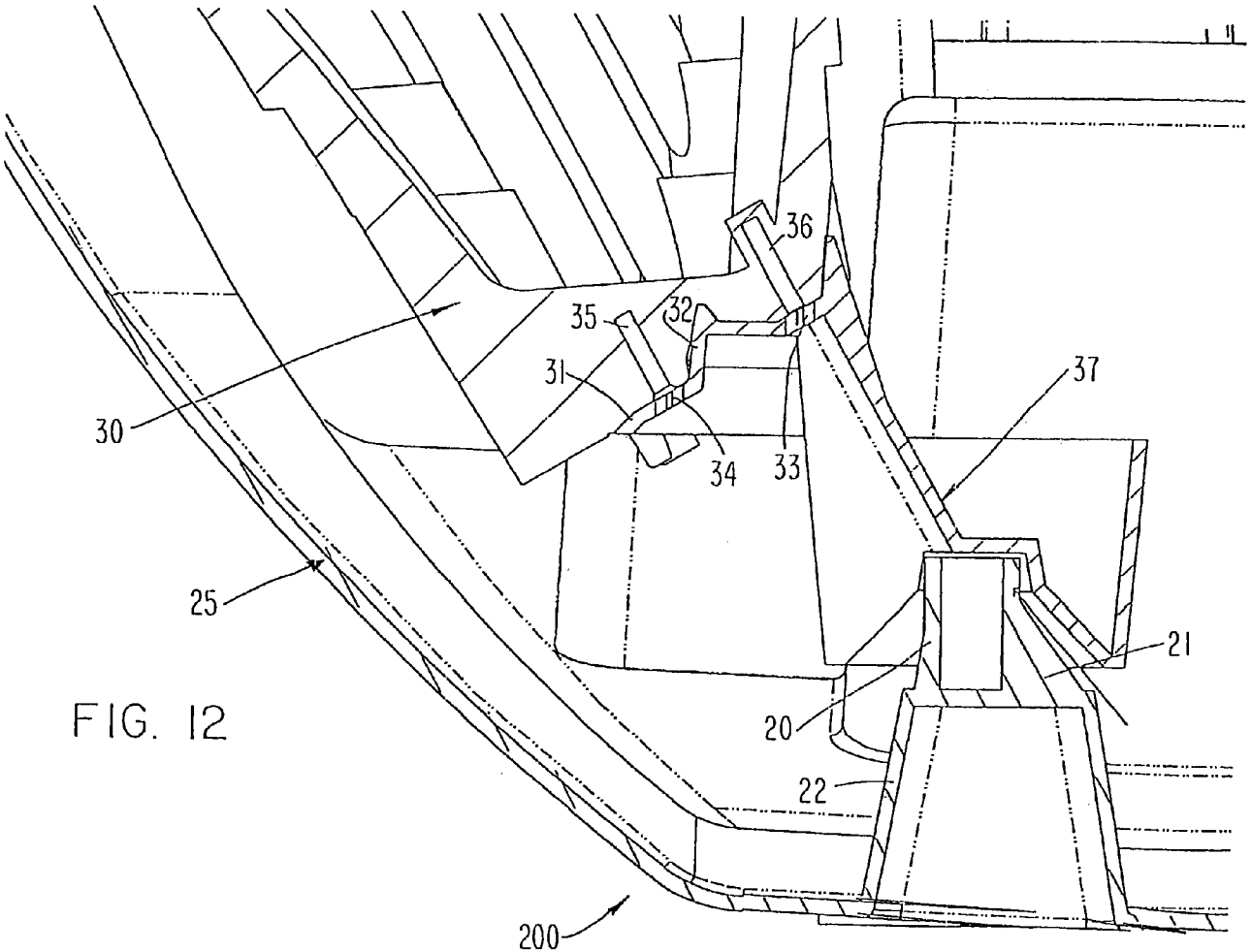
FIG. 12 is a top left side cross sectional view of the speaker bracket combination attached to the speaker cover and engages with the speaker boss according to the present invention.

FIG. 10 shows the speaker bracket 37 attached to the speaker cover 30 and also mated with the speaker boss. Although the speaker boss 20 is not shown mated with the mating surface of the speaker bracket 37, the platform 22 can be seen below the bracket 37. FIGS. 11 and 12 are provided to better describe the relationship between the 30 and the speaker boss 20 in a 32 or 36 inch television using the bracket 37. FIG. 11 is a front side view of the speaker bracket 37 attached to the speaker cover 30 and engaged with the speaker boss 20 according to the present invention. FIG. 12 is a top cross sectional view of the bracket 37—speaker cover 30—speaker boss 20 combination.

Figure 13:
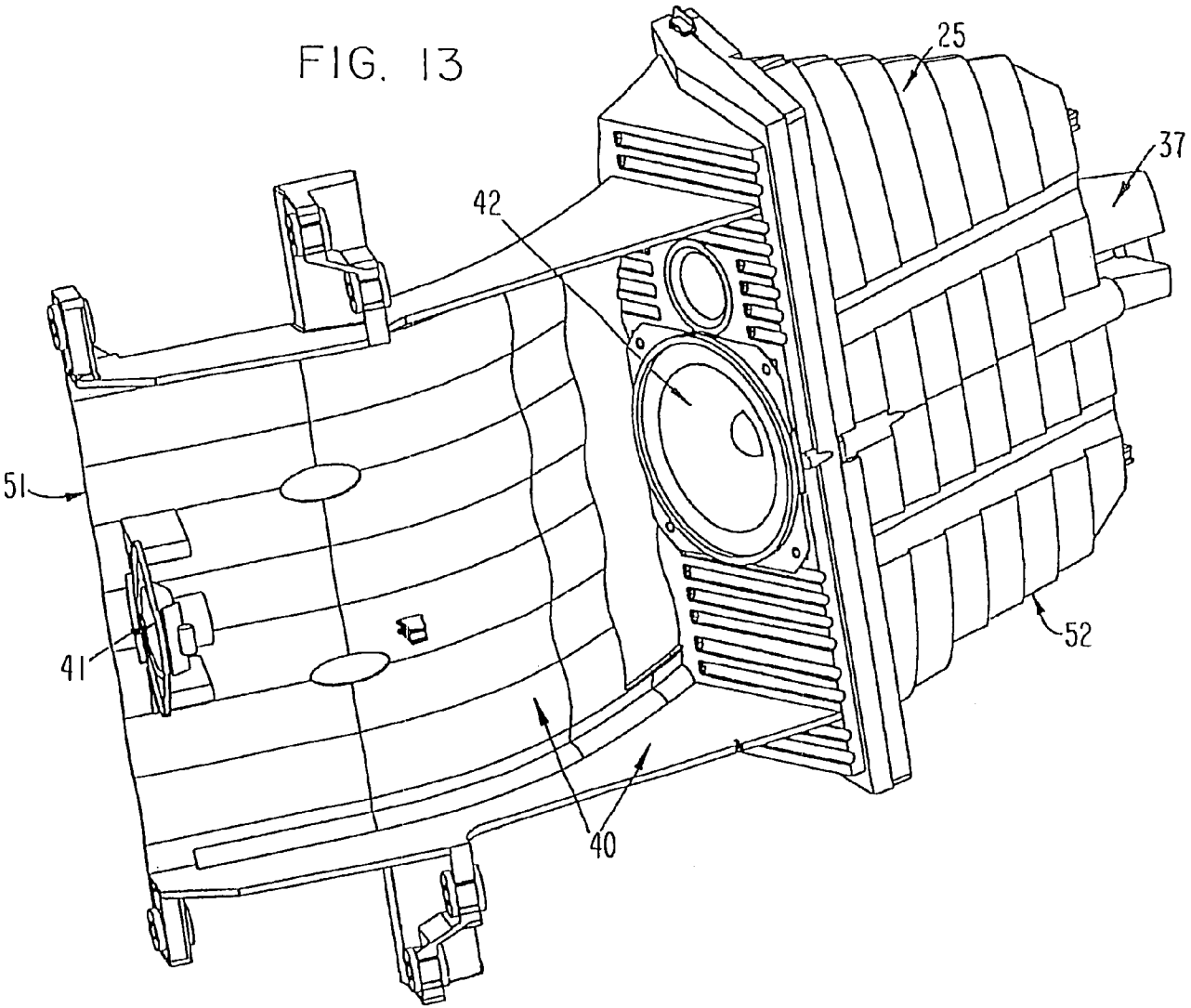
FIG. 13 is an isometric view of an assembled, uninstalled speaker box assembly and speaker baffle according to the present invention.
Figure 14:
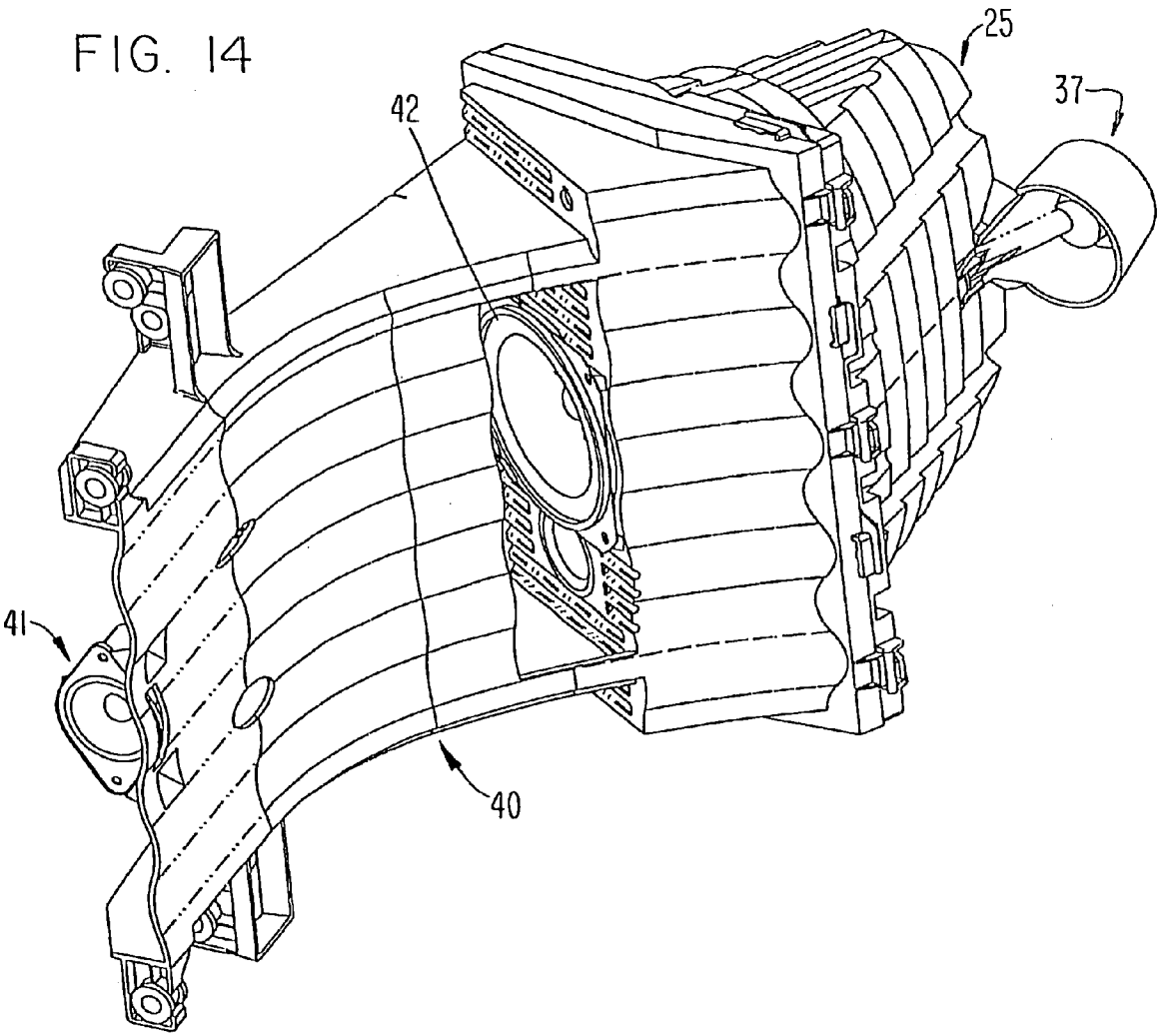
FIG. 14 is an opposite isometric view, relative to FIG. 13, of an assembled, uninstalled speaker box assembly and speaker baffle according to the present invention.

FIGS. 13 and 14 each shows the speaker box assembly 50 of the present invention. The assembly 50 includes the above-described speaker bracket 37, the speaker cover 25, and the speaker baffle 40. The assembly 50 also includes a smaller speaker 41 disposed toward the front of the television set 200 when installed, and a larger speaker 42 that is disposed rearward relative to the smaller speaker 41 when installed. As set forth above, when the television set has a 27-inch screen, the speaker bracket 37 is not attached to the speaker box assembly 50.

Figure 15:
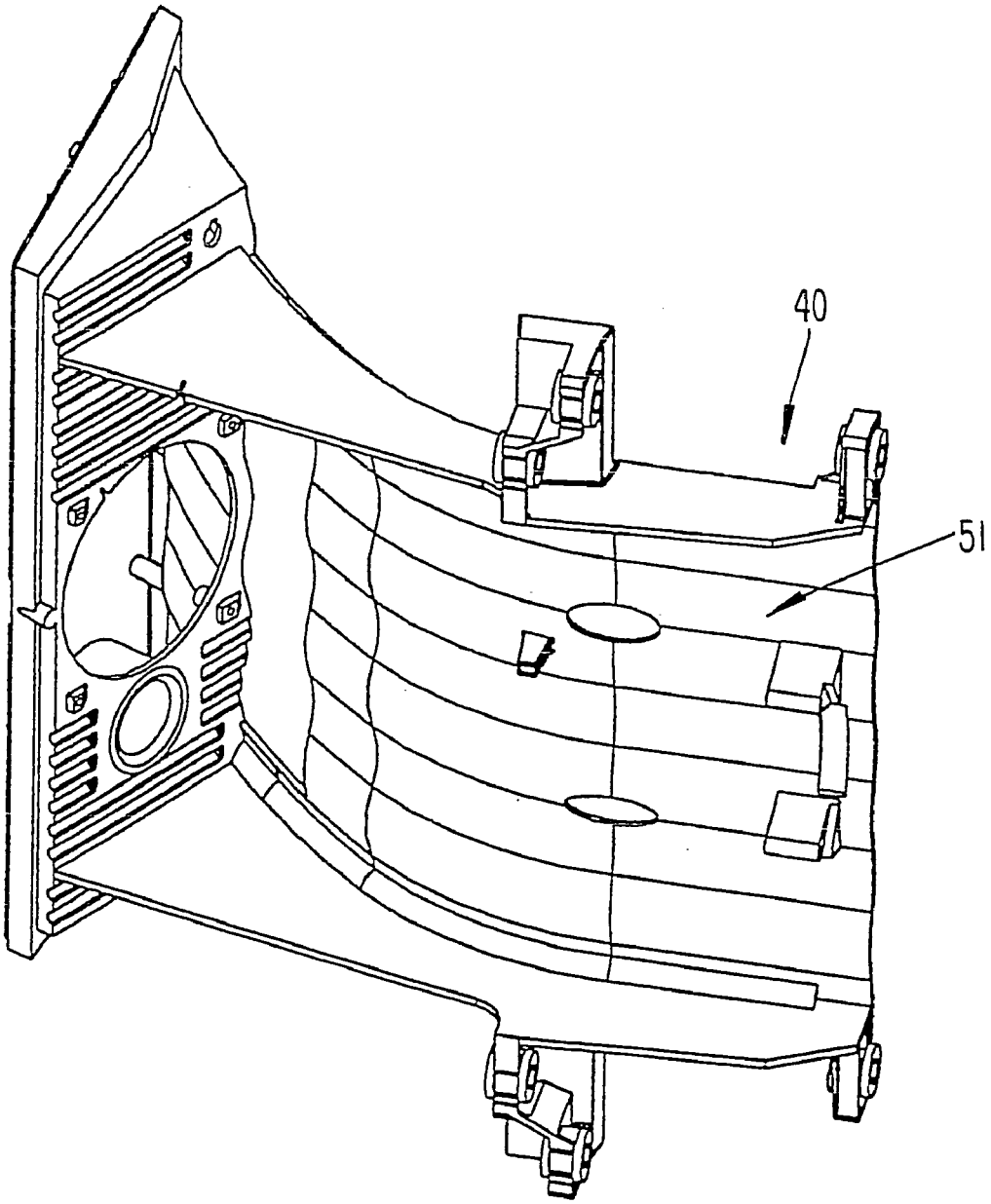
FIG. 15 is an isometric view of a speaker baffle according to the present invention.
Figure 16:
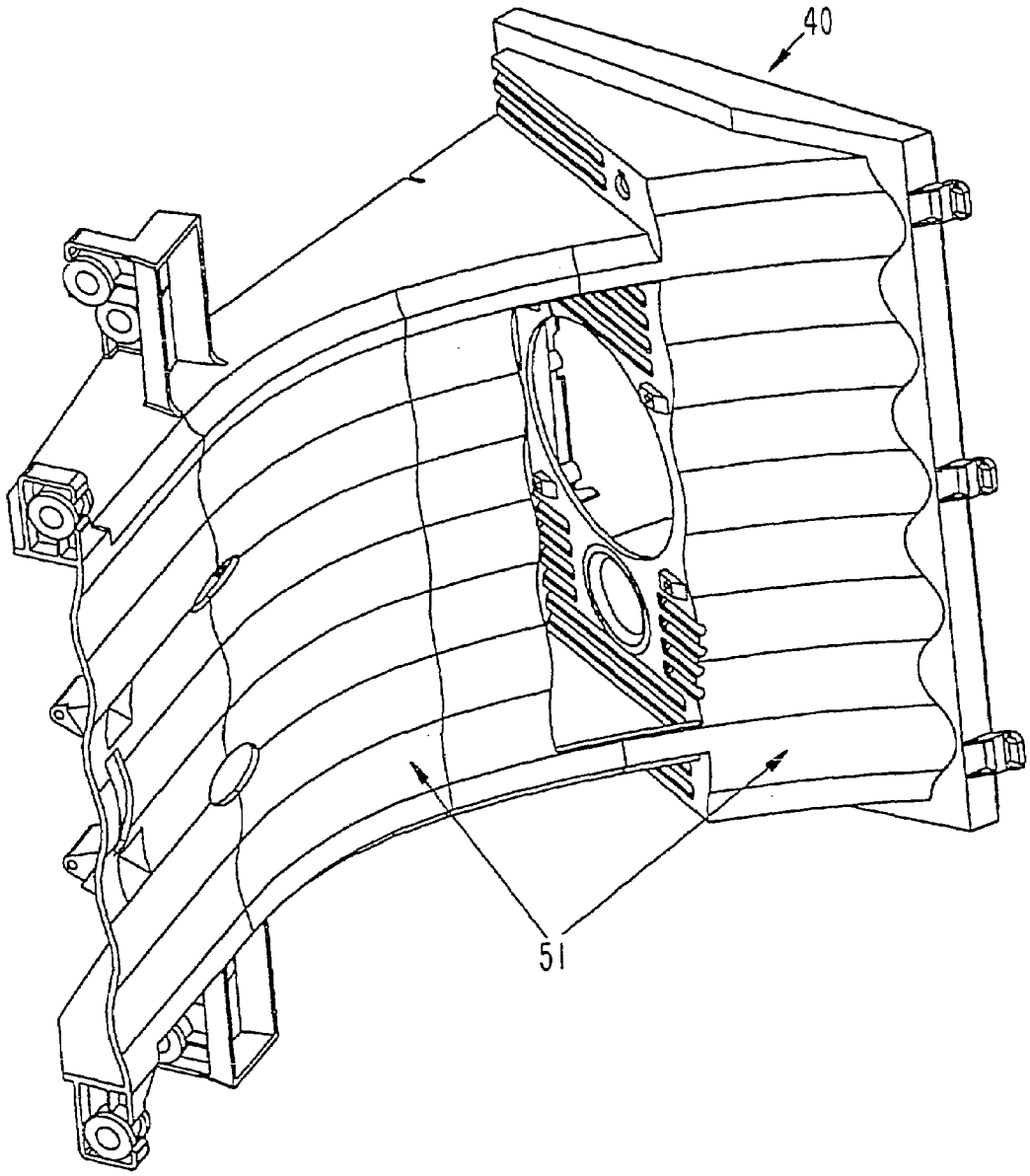
FIG. 16 is an opposite isometric view, relative to FIG. 15, of a speaker baffle according to the present invention.

FIGS. 15 and 16 each shows the speaker baffle 40 of the present invention. The speaker baffle 40 has a curved structure that allows either of two speaker box assemblies 50 to be installed on either side of a cathode ray tube funnel (not shown). A corrugated surface 51 defines a curved surface that faces the cathode ray tube when the speaker box assembly 50 is installed. Each corrugation of the surface 51 runs along the length of the surface 51, so that the width of the surface 51 has a wavy cross section. The corrugated surface 51 is formed with a curvature that fits the speaker baffle 40 around a cathode ray tube in the television set 100. The corrugated surface 51 has a plurality of crests and valleys that can extend in a direction that is perpendicular to a valley formed by the curvature. The uppermost portions of the crests can share a common plane. The valleys of the corrugations can each have a bottom-most surface, where the bottom-most surfaces also share a common plane.

The manufacturing method of the present invention, including providing the above-described corrugated and curved surface 51, requires less plastic materials than the conventional method of manufacturing speaker baffles, i.e. providing a flat surface with webs of reinforcing rib structures. As a result, the speaker baffles 40 of the present invention are cheaper and lighter than conventional speaker baffles. Furthermore, the speaker baffles 40 of the present invention have sufficient mechanical strength and stiffness to withstand sound vibrations caused by the speakers mounted in the speaker box assembly 50. The improved design allows further reduction of materials in that the necessary strength and stiffness is provided even when the surface 51 is manufactured with a reduced thickness relative to conventional speaker baffles.

Figure 17:
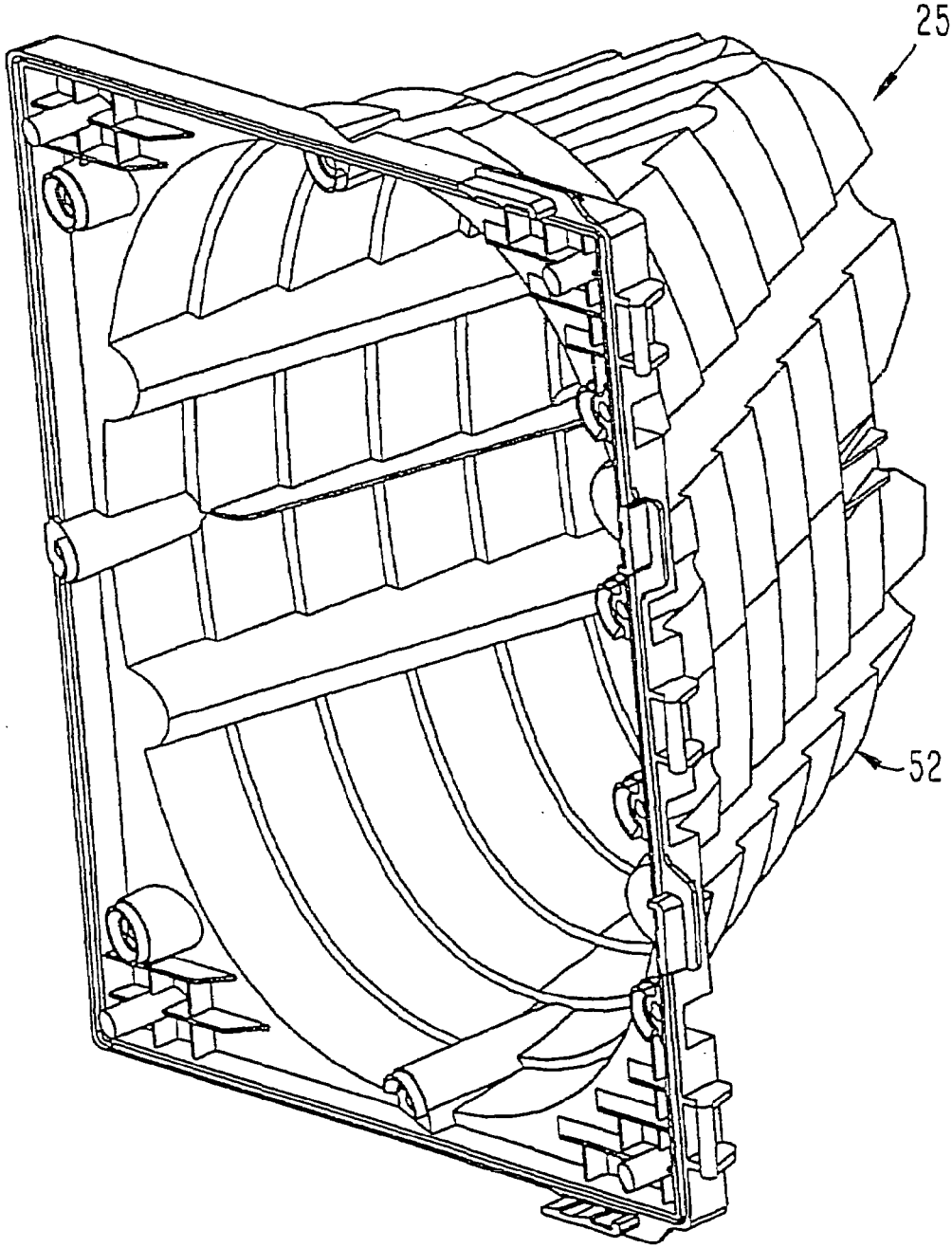
FIG. 17 is an isometric view of a speaker cover according to the present invention.
Figure 18:
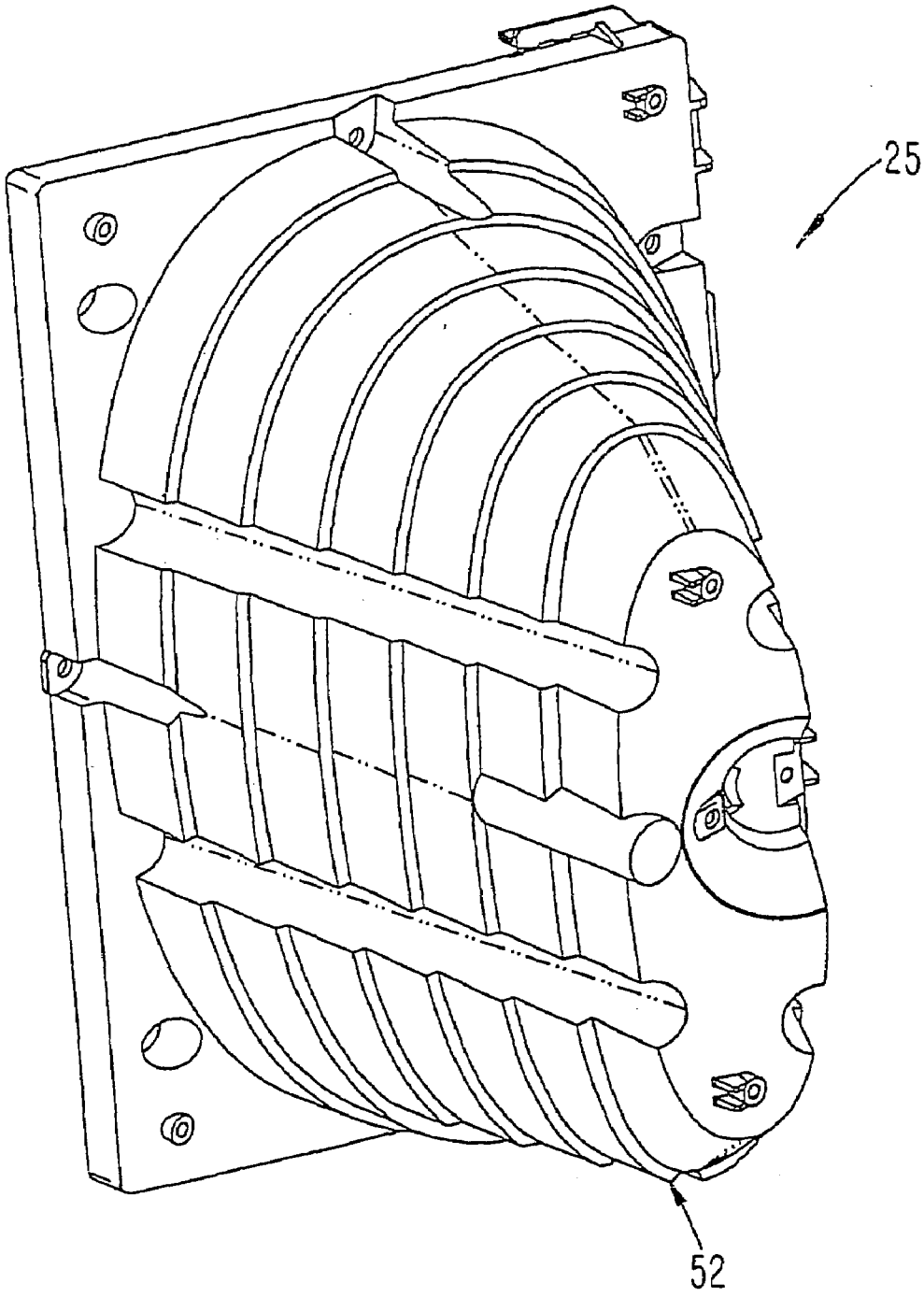
FIG. 18 is an opposite isometric view, relative to FIG. 17, of a speaker cover according to the present invention.

FIGS. 17 and 18 each shows the speaker cover 25 of the present invention. To prevent sound vibration, the speaker cover 25 is characterized by an elliptical surface 52 with increasing circumference at fixed intervals. This is accomplished by molding the surface 52 to have distinct steps. Grooves 53 in the surface 52 traverse along the speaker cover 25 perpendicular to the steps. The grooves 53 provide strength and stiffness to the speaker cover 25. The speaker cover is molded in the shape of an elliptical frustum instead of a conventional one-side opened rectangular box. This stepped surface design for the speaker cover 25 also is shaped to provide optimum speaker box volume, resulting in excellent sound reproduction from the whole speaker box assembly 50.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A television set speaker bracket, which comprises:

a stepped, inclined surface that is sized to closely fit inside a stepped, inverted semi-frustum surface of a television set speaker cover;

at least one attachment member for attaching said speaker bracket with said speaker cover; and a stepped, inverted surface that mates with a television set speaker boss, wherein said stepped, inverted surface has a stepped portion and an inverted surface, said inverted surface acting as a guide to assist said speaker boss to be brought toward, and engaged with said speaker bracket.

2. A television set speaker bracket according to claim 1, wherein said television set has a 32-inch viewing screen.

3. A television set speaker bracket according to claim 1, wherein said television set has a 36-inch viewing screen.

4. A television set speaker bracket according to claim 2 or 3, wherein said speaker cover is sized for a television set having a 27-inch viewing screen.

5. A television set speaker bracket according to claim 1, wherein said television set speaker boss is disposed on an interior surface of a rear cover of said television set.

6. A television set speaker bracket, which comprises:

a stepped, inclined surface that is sized to closely fit inside a stepped, inverted semi-frustum surface of a television set speaker cover;

at least one attachment member for attaching said speaker bracket with said speaker cover; and a stepped, inverted surface that mates with a television set speaker boss, wherein said stepped, inverted surface that guides said television set speaker boss into engagement with said speaker bracket is a semi-frustum shaped surface.

7. A television set speaker bracket according to claim 6, wherein said television set has a 32-inch viewing screen.

8. A television set speaker bracket according to claim 6, wherein said television set has a 36-inch viewing screen.

9. A television set speaker bracket according to claim 7, wherein said speaker cover is sized for a television set having a 27-inch viewing screen.

10. A television set speaker bracket according to claim 8, wherein said speaker cover is sized for a television set having a 27-inch viewing screen.

11. A television set speaker bracket according to claim 6, wherein said television set speaker boss is disposed on an interior surface of a rear cover of said television set.

* * * * *